US009696666B2

(12) United States Patent
Murayama

(10) Patent No.: US 9,696,666 B2
(45) Date of Patent: Jul. 4, 2017

(54) TRANSFER APPARATUS HAVING PRESSING MEMBER FOR TRANSFER BELT

(71) Applicant: CANON KABUSHIKI KAISHA, Tokyo (JP)

(72) Inventor: Tatsuomi Murayama, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/862,928

(22) Filed: Sep. 23, 2015

(65) Prior Publication Data

US 2016/0091835 A1 Mar. 31, 2016

(30) Foreign Application Priority Data

Sep. 25, 2014 (JP) ..... 2014-195818

(51) Int. Cl.
*G03G 15/16* (2006.01)

(52) U.S. Cl.
CPC ..... *G03G 15/1615* (2013.01)

(58) Field of Classification Search
CPC ..... G03G 15/1605; G03G 15/1615; G03G 15/1625; G03G 2215/0154
See application file for complete search history.

(56) References Cited

U.S. PATENT DOCUMENTS 6,321,052 B1 * 11/2001 Yamashina ..... G03G 15/167 399/165
7,546,074 B2 6/2009 Oyama
8,818,249 B2 8/2014 Kaseda
8,837,989 B2 9/2014 Yasumoto
2002/0034406 A1 3/2002 Kawagoe
2006/0104651 A1 5/2006 DiRubio
2007/0217832 A1 * 9/2007 Oyama ..... G03G 15/161 399/302
2009/0062048 A1 * 3/2009 Nakura ..... G03G 15/1615 474/135
2009/0162098 A1 6/2009 Shirakata
2009/0208257 A1 8/2009 Matsumoto
2010/0310286 A1 * 12/2010 Yasumoto ..... G03G 15/0131 399/302
2012/0207522 A1 * 8/2012 Nakajima ..... G03G 15/161 399/308
2013/0016996 A1 1/2013 Yuasa
2013/0071150 A1 3/2013 Takagi
2016/0041508 A1 * 2/2016 Kogure ..... G03G 15/161 399/316

FOREIGN PATENT DOCUMENTS

EP 1975737 A1 10/2008
JP H09-080926 A 3/1997
JP 2001-147601 A 5/2001
JP 2002-82543 A 3/2002
JP 2012-058605 A 3/2012
JP 2012-159747 A 8/2012
RU 2289835 C2 12/2006

* cited by examiner

*Primary Examiner* — Sandra Brase
(74) *Attorney, Agent, or Firm* — Canon USA, Inc., IP Division

(57) ABSTRACT

In an image forming apparatus including a pressing member arranged on an inner circumferential surface of an intermediate transfer belt, configured to correct a position of the intermediate transfer belt in the width direction to be fit within a movable region, positions of both ends of the pressing member in the width direction are respectively arranged outside positions of both ends of the movable region.

14 Claims, 9 Drawing Sheets

-- Prior Art --

-- Prior Art --

FIG.6

| | DISTANCE BETWEEN S1 AND N1 | | | | |
|---|---|---|---|---|---|
| | < 10 mm | 10 – 15 mm | 15 – 20 mm | 20 – 25 mm | > 25 mm |
| WHITE SPOT PHENOMENON | GOOD | GOOD | FAIR | FAIR | POOR |

TRANSFER APPARATUS HAVING PRESSING MEMBER FOR TRANSFER BELT

BACKGROUND OF THE INVENTION

Field of the Invention

The present invention relates to an image forming apparatus such as a copying machine and a laser printer employing an electro-photographic technique.

Description of the Related Art

In an image forming apparatus configured to transfer a toner image formed on a belt such as an intermediate transfer belt onto a recording material, if the intensity of a transfer field is too strong when the toner image is transferred onto the recording medium, an electric discharge may occur and cause a so-called "white spot phenomenon" in which a white void region is formed on an image.

The electric discharge that causes the white spot phenomenon occurs in a space between the belt and the recording material, and the white spot phenomenon is likely to occur if the belt vibrates in the vicinity of a transfer portion.

Therefore, Japanese Patent Application Laid-Open No. 2002-82543 discusses a configuration in which a vibration prevention sheet is pressed against an inner circumferential surface of the belt in order to suppress vibration of the belt in the vicinity of the transfer portion.

However, as illustrated in (a) of FIG. 2, if the length of the vibration prevention sheet in a width direction of the belt is set to be shorter than the width of the belt, end portions of the vibration prevention sheet contact the rear surface of the belt. Because tensile force is applied to the belt through a tension roller, as illustrated in (b) of FIG. 2, stress from the vibration prevention sheet applied to the belt is concentrated in the vicinity of the end portions of the vibration prevention sheet, so that a large quantity of particles scraped from the belt will be generated.

Further, in a case where the belt is provided with a correction mechanism for correcting the movement (deviation) of the belt in the width direction thereof, the stress is further concentrated at end portions X in the moving direction of the belt as illustrated in FIG. 3, so that the scraping of the belt will be accelerated.

If the generated scraped particles adhere to the rollers that constitute the transfer portion, they may gradually enter the image region while the belt is being moved continuously, and variation in the transfer electric field may arise, which in turn may cause image defects.

SUMMARY OF THE INVENTION

According to an aspect of the present invention, an image forming apparatus includes an endless intermediate transfer belt, a toner image forming unit configured to form a toner image on the intermediate transfer belt, a first transfer member arranged outside the intermediate transfer belt in contact with the intermediate transfer belt, configured to electrostatically transfer the toner image formed on the intermediate transfer belt onto a recording material, a second transfer member arranged inside the intermediate transfer belt at a position opposing the first transfer member across the intermediate transfer belt, configured to stretch the intermediate transfer belt, a suppression mechanism configured to suppress deviation of the intermediate transfer belt in a width direction, and a pressing member configured to press the intermediate transfer belt from the inside at a position adjacent to and on the upstream side of the second transfer member in the moving direction of the intermediate transfer belt, end portions, in the width direction, of the pressing member being arranged outside of a moving region of the intermediate transfer belt in the width direction.

Further features of the present invention will become apparent from the following description of exemplary embodiments with reference to the attached drawings. Each of the embodiments of the present invention described below can be implemented solely or as a combination of a plurality of the embodiments or features thereof where necessary or where the combination of elements or features from individual embodiments in a single embodiment is beneficial.

BRIEF DESCRIPTION OF THE DRAWINGS

FIG. 6 is a table illustrating a relationship between positions of the vibration prevention member and an image according to the first exemplary embodiment.

DESCRIPTION OF THE EMBODIMENTS

Figure 1:
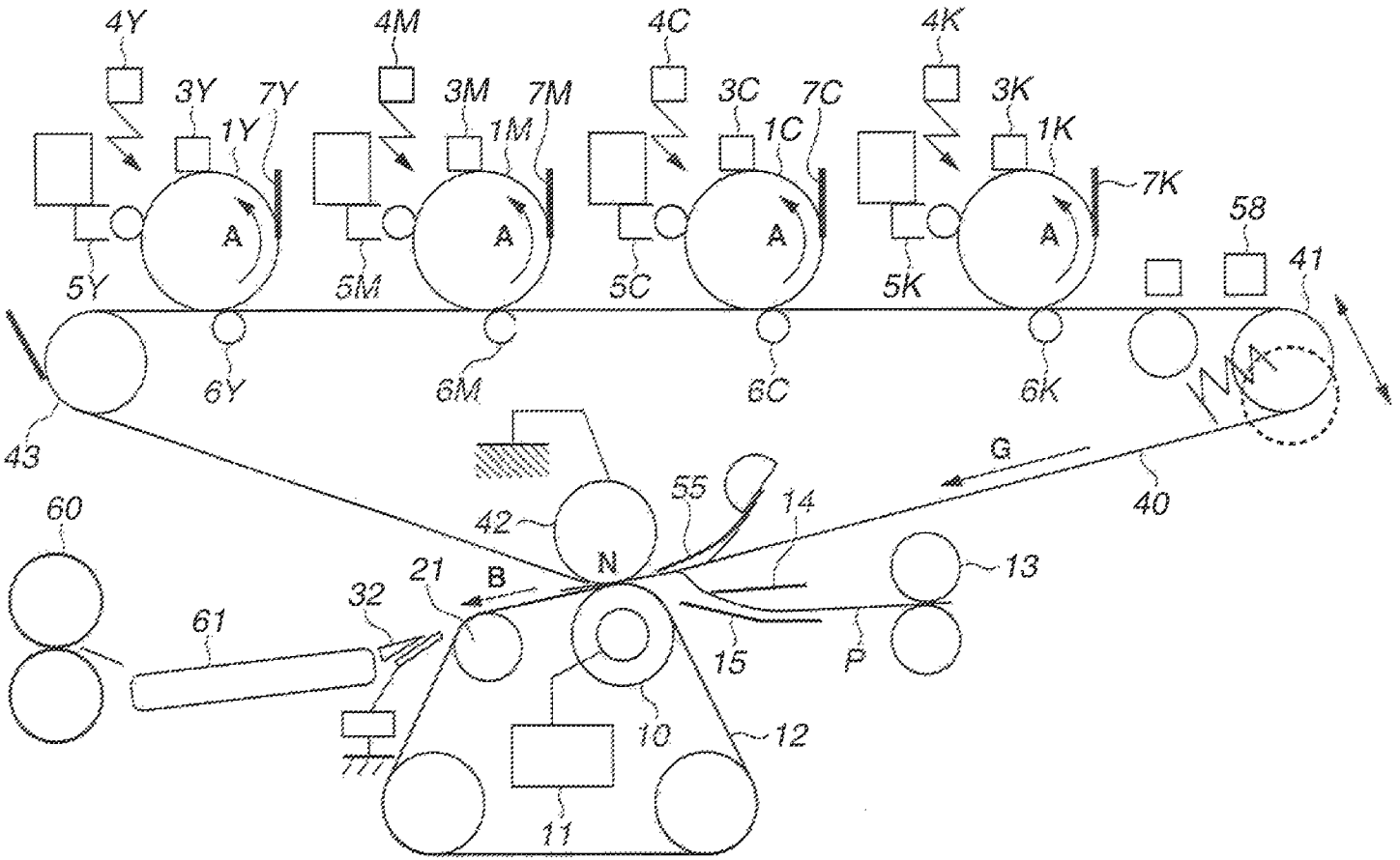
FIG. 1 is a diagram illustrating an entire configuration of an image forming apparatus according to a first exemplary embodiment.
Figure 2:
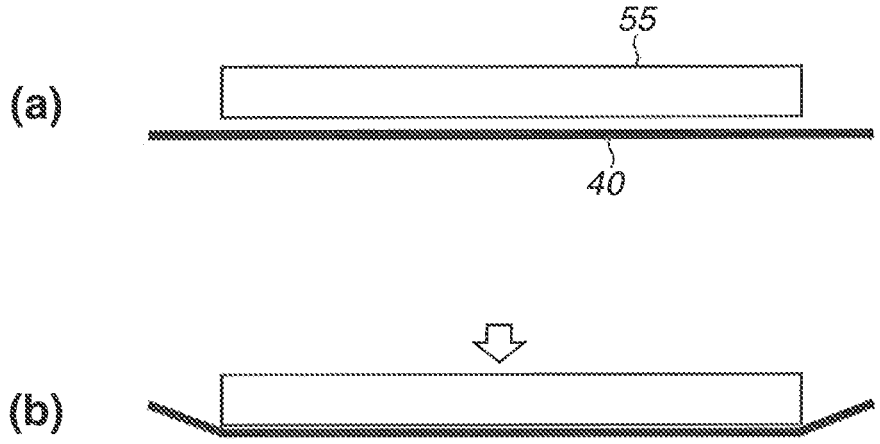
FIG. 2 is a diagram illustrating abutting states of an intermediate transfer member and a vibration prevention member according to a comparative example.
Figure 3:
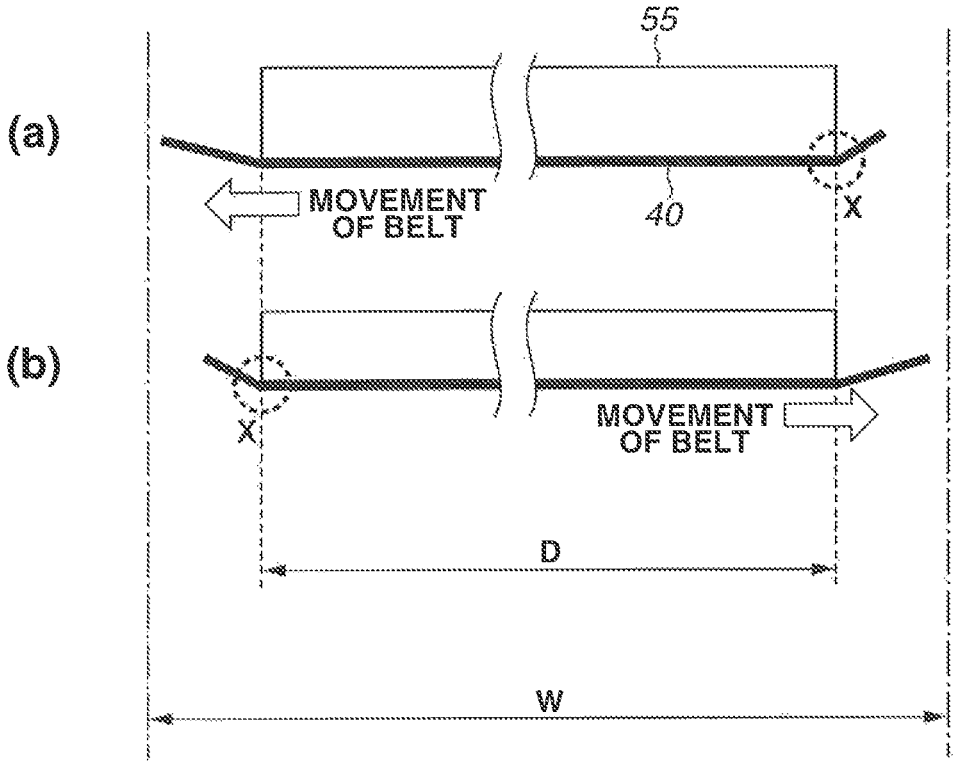
FIG. 3 is a diagram illustrating abutting states of a moved intermediate transfer member and a vibration prevention member according to a comparative example.

FIG. 1 is a diagram illustrating a configuration of an image forming apparatus according to a first exemplary embodiment.

Photosensitive drums (latent image bearing members) 1Y, 1M, 1C, and 1K rotate in directions indicated by arrows A, and the surfaces thereof are uniformly charged by primary charging devices 3Y, 3M, 3C, and 3K. Exposure devices 4Y, 4M, 4C, and 4K irradiate the photosensitive drums 1Y, 1M, 1C, and 1K based on image information. Electrostatic latent images according to the image information are formed on the photosensitive drums 1Y, 1M, 1C, and 1K through known electro-photographic processing.

Development devices 5Y, 5M, 5C, and 5K respectively contain toner in chromatic colors of yellow (Y), magenta (M), cyan (C), and black (K). The above-described electrostatic latent images are developed by the development devices 5Y, 5M, 5C, and 5K, so that toner images are formed on the photosensitive drums 1Y, 1M, 10, and 1K. A reversal development system in which development is executed by adhering toner to exposed portions of the electrostatic latent images is employed.

The electrostatic latent images formed by the exposure devices 4 (4Y, 4M, 4C, and 4K) are aggregations of dot images, so that density of the toner images formed on the photosensitive drums 1 (1Y, 1M, 10, and 1K) can be changed by changing the density of the dot images. In the present exemplary embodiment, a maximum density of each toner image is approximately 1.5 to 1.7, and an applied toner amount of the maximum density is 0.4 mg/cm$^2$ to 0.6 mg/cm$^2$.

An intermediate transfer belt 40 is arranged to contact the surfaces of the photosensitive drums 1. The intermediate transfer belt 40 is stretched around a tension roller 41, a transfer counter roller 42, and a driving roller 43, and moves in a direction indicated by an arrow G at a speed of 250 mm/sec. to 300 mm/sec.

In the present exemplary embodiment, the tension roller 41 is arranged on an inner circumferential surface side of the intermediate transfer belt 40 in order to apply tensile force to the intermediate transfer belt 40.

The driving roller 43 is arranged on the inner circumferential surface side of the intermediate transfer belt 40 in order to move the intermediate transfer belt 40 by applying driving force thereto.

Further, the transfer counter roller (second roller) 42 is arranged on the inner circumferential surface side of the intermediate transfer belt 40 to face a transfer roller (first roller) 10 via the intermediate transfer belt 40 and a secondary transfer belt 12, and a transfer electric field is generated therebetween. The transfer counter roller 42 and the transfer roller 10 form a transfer nip N.

The tension roller 41 applies tensile force to the intermediate transfer belt 40 through an urging member that urges the intermediate transfer belt 40 toward the outer circumferential surface side. The urging force from the urging member generates the tensile force of approximately 2 kgf to 5 kgf to the intermediate transfer belt 40 in the moving direction thereof.

The intermediate transfer belt 40 is an endless belt having a three-layer structure consisting of a resin layer, an elastic layer, and a surface layer in this order from a rear surface thereof. A material such as polyimide or polycarbonate is used as the resin material constituting the resin layer. The resin layer has a thickness of 70 μm to 100 μm. A material such as polyurethane rubber or chloroprene rubber is used as the elastic material constituting the elastic layer. The elastic layer has a thickness of 200 μm to 250 μm.

The surface layer has to be made of a material that reduces the adhesion of toner with respect to the outer circumferential surface of the intermediate transfer belt 40 while allowing the toner to be easily transferred onto the recording material P at the transfer nip N. For example, a resin material such as polyurethane or an elastic material in which powders or particles of fluorine resin are dispersed therein may be used therefor. In addition, the surface layer has a thickness of 5 μm to 10 μm.

Conductive agent such as carbon black for adjusting a resistance value is added to the material of the intermediate transfer belt 40, so that the intermediate transfer belt 40 has a volume resistivity of 1E+9 Ω·cm to 1E+14 Ω·cm.

The endless intermediate transfer belt 40 is arranged facing the photosensitive drums 1Y, 1M, 1C, and 1K. The toner images formed on the photosensitive drums 1Y, 1M, 1C, and 1K are electrostatically primary-transferred onto the intermediate transfer belt 40 by the primary transfer units 6Y, 6M, 6C, and 6K sequentially, so that the toner images in four colors are superimposed to form a full-color image on the intermediate transfer belt 40. In other words, the photosensitive drums 1, the primary charging devices 3 (3Y, 3M, 3C, and 3K), the exposure devices 4, the development devices 5 (5Y, 5M, 5C, and 5K), and the primary transfer units 6 (6Y, 6M, 6C, and 6K) constitute toner image forming units to form toner images on the intermediate transfer belt 40.

Cleaning devices 7Y, 7M, 7C, and 7K clean transfer residual toner from the surfaces of the photosensitive drums 1 each time the photosensitive drums 1 rotate once after one primary transfer step, so that the photosensitive drums 1 execute the image forming step repeatedly.

The toner image formed on the intermediate transfer belt 40 is moved in the direction indicated by the arrow G and conveyed to the transfer nip N. On the other hand, recording materials P are stored in a cassette (not illustrated). When a feeding roller (not illustrated) is driven based on an image formation start signal, the recording materials P stored in the cassette are fed one-by-one, and conveyed by a registration roller 13 in an orientation indicated by an arrow B.

The recording material P conveyed by the registration roller 13 is stopped thereat temporarily. Then, in synchronization with the toner image on the intermediate transfer belt 40 conveyed to the transfer nip N, the recording material P is supplied to the transfer nip N. An upper guide 14 for regulating behavior of the recording material P approaching the front surface of the intermediate transfer belt 40 is arranged on the front surface side of the intermediate transfer belt 40 on the upstream side of the transfer nip N. Furthermore, a lower guide 15 for regulating behavior of the recording material P separating from the front surface of the intermediate transfer belt 40 is arranged. A conveyance path through which the recording material P is conveyed to the transfer nip N from the registration roller 13 is regulated by the guides 14 and 15.

When the recording material P passes through the transfer nip N, transfer bias in a polarity opposite to the polarity of the toner image is applied to the transfer roller 10. With this operation, a transfer electric field is generated at the transfer nip N, so that the toner image on the intermediate transfer belt 40 is collectively transferred onto the recording material P supplied to the transfer nip N. In the present exemplary embodiment, an electric current of +40 uA to 60 uA is applied thereto.

The transfer roller 10 is arranged on the outer circumferential surface side of the intermediate transfer belt 40. The transfer roller 10 has an outer diameter of 24 mm, and consists of an elastic layer made of ion-conductive foamed rubber (nitrile rubber (NBR)) and a core metal. The transfer roller 10 has a roller surface roughness of Rz=6.0 μm to 12.0 μm, and a resistance value of 1E+5Ω to 1E+7Ω in the measurement range N/N (23° C., 50% RH) with applied voltage of 2 kV. The elastic layer has the Asker-C hardness of 30 to 40.

A variable-bias high-voltage power source 11 is attached to the transfer roller 10, so that a transfer electric field is generated in order to transfer the toner image formed on the intermediate transfer belt 40 onto the recording material P.

The transfer belt 12 is moved in a direction indicated by the arrow B. The recording material P is adhered to the secondary transfer belt 12 and conveyed to the downstream. Of the tension rollers for the secondary transfer belt 12, a tension roller 21 arranged on the downstream side of the transfer roller 10 serves also as a separation roller. The recording material P on the secondary transfer belt 12 is separated therefrom due to the curvature of the tension roller 21.

The secondary transfer belt 12 is made of a resin material such as polyimide that contains an appropriate amount of carbon black as an antistatic agent so as to have a volume resistivity of 1E+9 Ω·cm to 1E+14 Ω·cm, and a thickness of 0.07 mm to 0.1 mm. Further, a value of the Young's module of the secondary transfer belt 12 measured by a tensile testing method compliant with Japanese Industrial Standard (JIS) K6301 is approximately equal to or greater than 100 MPa and equal to or smaller than 10 GPa.

The recording material P separated from the secondary transfer belt 12 is conveyed to a fixing device 60 by a conveyance member provided on the downstream side. In the present exemplary embodiment, the image forming apparatus includes a separation claw 32 for preventing the recording material P separated from the secondary transfer belt 12 from electrostatically winding around the secondary transfer belt 12 again and a pre-fixing conveyance device 61 arranged on the downstream side thereof, which conveys the recording material P to the fixing device 60. After the fixing device 60 fixes the unfixed toner image onto the recording material P, the recording material P is discharged to the outside of the image forming apparatus.

Next, description will be given to a vibration prevention member (pressing member) 55 arranged on the inner circumferential surface side of the intermediate transfer belt 40.

Figure 4:
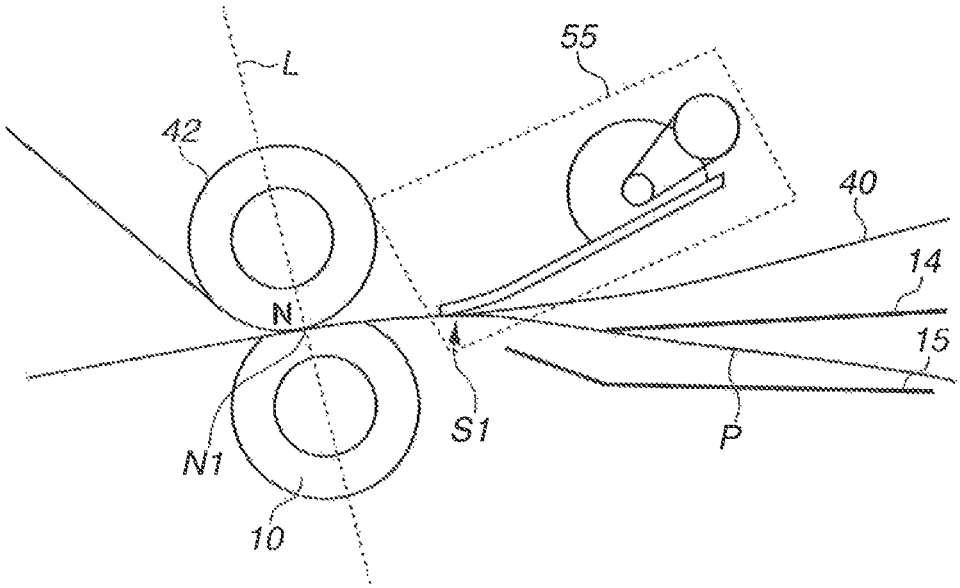
FIG. 4 is a diagram illustrating a detailed configuration of a secondary transfer portion according to the first exemplary embodiment.

FIG. 4 is a diagram illustrating the vibration prevention member 55 arranged in the vicinity of the transfer nip N.

The vibration prevention member 55 is arranged adjacent to the transfer nip N on the upstream side in the movement direction of the intermediate transfer belt 40, and is in contact with the inner circumferential surface of the intermediate transfer belt 40.

Figure 5:
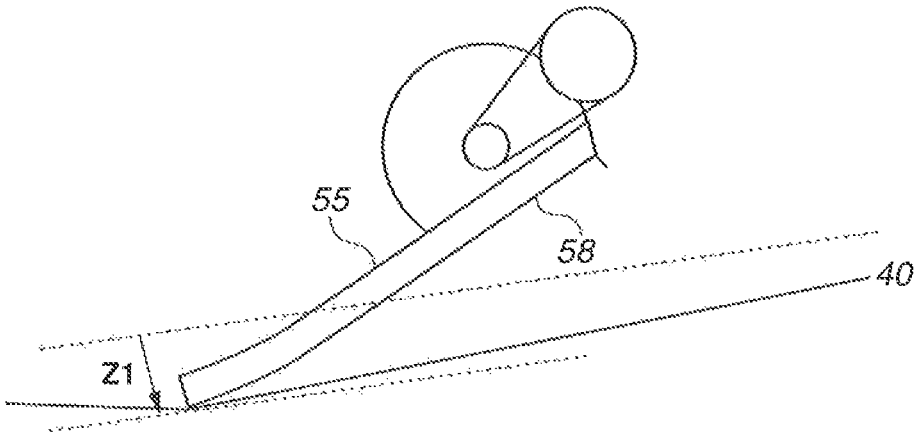
FIG. 5 is a diagram illustrating an abutting state of a vibration prevention member and an intermediate transfer belt according to the first exemplary embodiment.

FIG. 5 is a detailed diagram illustrating a state where the vibration prevention member 55 having a sheet shape is in contact with the intermediate transfer belt 40.

In FIG. 4, it is preferable that the vibration prevention member 55 is arranged so that the distance between a point S1 and a point N1 is equal to or less than 25 mm. The point S1 is a point at which a leading end of the vibration prevention member 55 makes contact with the intermediate transfer belt 40, and a point N1 is a point at which a line L that connects the rotation centers of the transfer roller 10 and the counter roller 42 intersects with the intermediate transfer belt 40. In the present exemplary embodiment, in order to suppress the vibration of the intermediate transfer belt 40, a resin material such as a polyester sheet having a thickness of 0.4 mm to 0.6 mm is used for the vibration prevention member 55. As illustrated in FIG. 5, the vibration prevention member 55 is arranged so that a changed amount Z1 of the stretched surface of the intermediate transfer belt 40 is set to be 1.0 mm to 3.0 mm.

FIG. 6 is a table illustrating an improvement effect of the white spot phenomenon acquired through a vibration suppressing method according to the present exemplary embodiment. As illustrated in FIG. 6, if the distance between the point S1 and the point N1 is longer than 25 mm, the improvement effect of the white spot phenomenon is hardly obtained. The vibration of the intermediate transfer belt 40 can be suppressed when the vibration prevention member 55 makes contact with the intermediate transfer belt 40 at a position adjacent to the transfer nip N as close as possible. In the present exemplary embodiment, the vibration prevention member 55 is arranged at a position where the distance between the point S1 and the point N1 is approximately 10 mm.

It is known that the intermediate transfer belt moves (deviates) in a width direction intersecting with the moving direction of the intermediate transfer belt (hereinafter, "width direction") due to a slight tilt of the tension roller, a difference in a tensile force of the intermediate transfer belt, or an external load applied thereto. In order to solve such a deviation arising in the intermediate transfer belt, conventionally, a correction unit is sometimes used in order to correct a position of the intermediate transfer belt in the width direction to fit the intermediate transfer belt into a predetermined region (i.e., movable region). Examples of the correction unit include a correction unit that inclines a steering roller based on detected information of the position in the width direction of the intermediate transfer belt to make the intermediate transfer belt move in a direction opposite to the direction in which the intermediate transfer belt has deviated.

Furthermore, as another example of the correction unit, there is provided a correction unit that inclines a steering roller by a frictional force generated between a resting portion arranged at the end portion of the steering roller and the intermediate transfer belt to cause the intermediate transfer belt to move when the intermediate transfer belt has deviated in the width direction. However, the methods of the correction unit are not limited to those described in the present exemplary embodiment.

In FIG. 1, the image forming apparatus includes a belt edge detection unit 58. A position of the edge in the width direction of the intermediate transfer belt 40 is detected by the belt edge detection unit 58, so that an inclination angle of the tension roller (steering roller) is corrected based on the detected information. A moving unit (not illustrated) inclines the tension roller (steering roller) by causing one portion of a shaft in the width direction to move in a direction indicated by an arrow in FIG. 1.

In the present exemplary embodiment, the intermediate transfer belt 40 has a length of 360 mm in the width direction. A position of the intermediate transfer belt 40 is controlled to be within a range of ±2.5 mm in the width direction with respect to a reference position. Accordingly, a width of the maximum range (movable region) in which the intermediate transfer belt 40 moves in the width direction is 365 mm.

In the present exemplary embodiment, the vibration prevention member 55 for preventing the vibration of the intermediate transfer belt 40 is arranged to make contact with the rear surface of the intermediate transfer belt 40 at a position adjacent to the transfer nip N on the upstream side thereof. The vibration prevention member 55 is fixed to a side plate within the main body, so that the vibration prevention member 55 does not interlock with the inclination of the tension roller 41 (steering roller).

Figure 7:
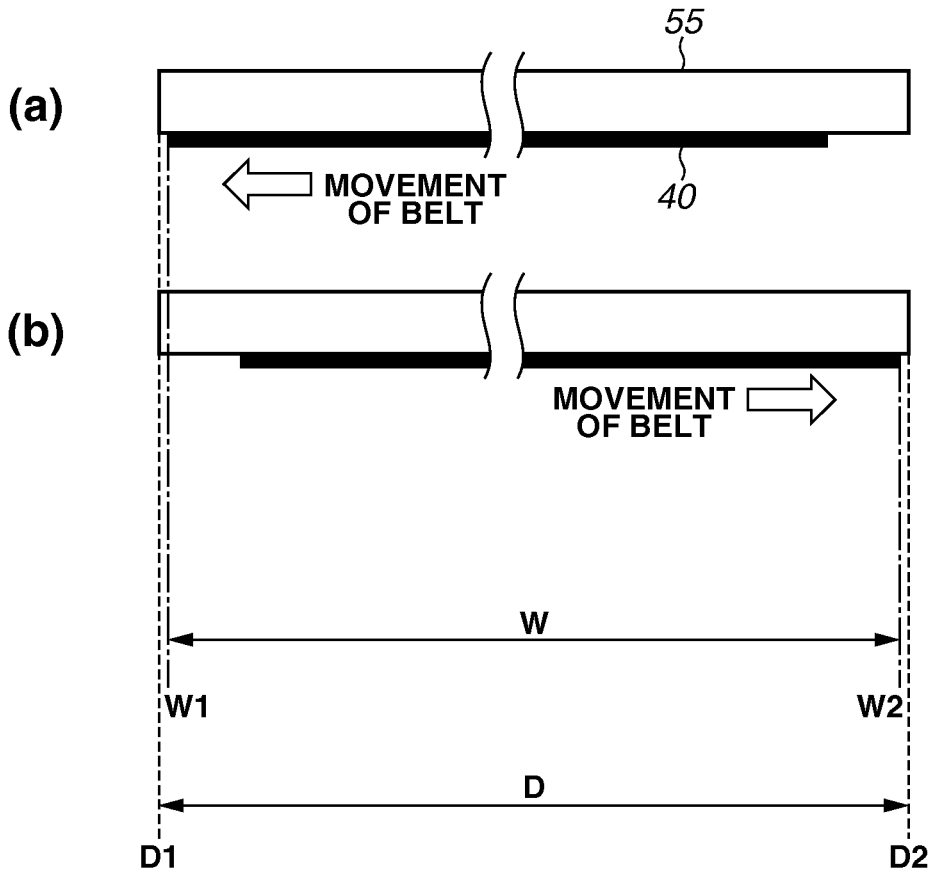
FIG. 7 is a diagram illustrating abutting states of the vibration prevention member and the intermediate transfer belt in a width direction according to the first exemplary embodiment.

FIG. 7 is a diagram illustrating relationship between the lengths of the vibration prevention member 55 and the intermediate transfer belt 40 in the width direction.

In the width direction, a length D of the vibration prevention member 55 is set to be longer than a length W of the movable region of the intermediate transfer belt 40. With this configuration, even in a case where the intermediate transfer belt 40 is moved to an outermost position in the width direction as illustrated in (a) or (b) of FIG. 7, the edge of the vibration prevention member can be prevented from contacting the intermediated transfer belt 40.

In the present exemplary embodiment, by taking warping or assembly accuracy of components into consideration, the length of the vibration prevention member 55 in the width direction is set to 367 mm, which is 2 mm longer than 365 mm, i.e., a length in the width direction of the movable range.

Further, positions D1 and D2 of the end portions of the vibration prevention member 55 in the width direction are respectively arranged on the outside of positions W1 and W2 of the end portions of the movable region.

With the above-described configuration, even if the intermediate transfer belt 40 is moved to the outermost position in the width direction, the edge of the vibration prevention member 55 does not contact the intermediate transfer belt 40, and thus an image defect caused by generation of scraping particles can be suppressed.

In the first exemplary embodiment, a portion of the vibration prevention member 55 which makes contact with the intermediate transfer belt 40 has a sheet shape. However, the present invention is also applicable to a vibration prevention member a portion of which that makes contact with the intermediate transfer belt 40 has a roller shape.

Figure 8:
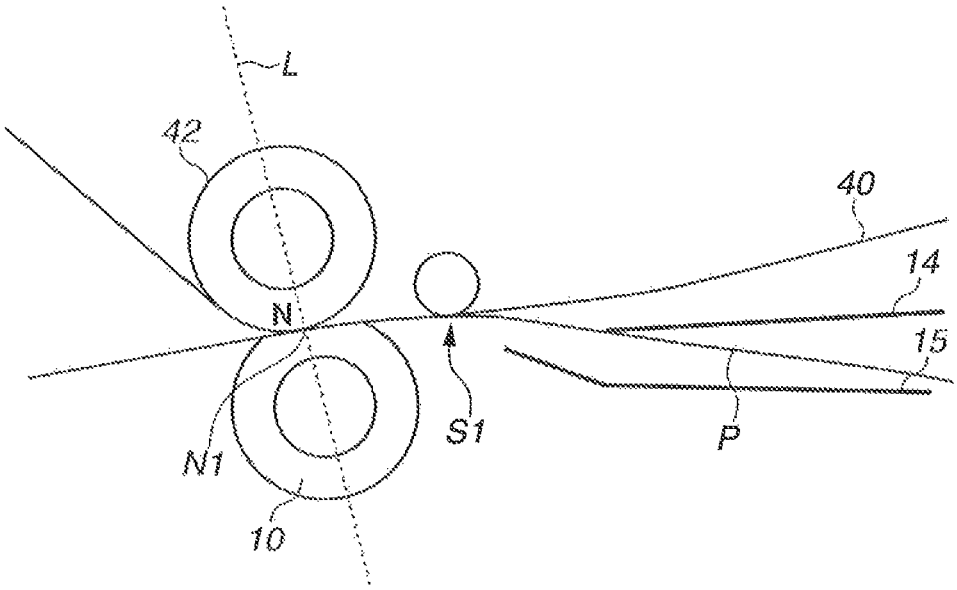
FIG. 8 is a diagram illustrating a detailed configuration of a vibration prevention member according to a second exemplary embodiment.

As illustrated in FIG. 8, in a second exemplary embodiment, the present invention is applied to a vibration prevention member a portion of which that makes contact with the intermediate transfer belt 40 has a roller shape.

A roller portion which makes contact with the intermediate transfer belt 40 is made of metal having a diameter of 8 mm to 10 mm, and bearings are provided on both ends thereof. The roller portion is configured to be rotated along with the movement of the intermediate transfer belt 40.

According to the present exemplary embodiment, the intermediate transfer belt 40 has a length of 360 mm in the width direction, the movable region has a length W of 365 mm in the width direction, and the roller-shape portion has a length D of 367 mm in the width direction. Positions D1 and D2 at both ends of the roller-shape portion in the width direction are respectively arranged outside of positions W1 and W2 of both ends of the movable region.

In the present exemplary embodiment, the edges of the roller-shape portion do not make contact with the intermediate transfer belt 40, and thus an image defect caused by generation of scraped particles can be suppressed.

In the first exemplary embodiment, a leading end of the vibration prevention member 55 makes contact with the intermediate transfer belt 40 at one position in the moving direction of the intermediate transfer belt 40.

Figure 9:
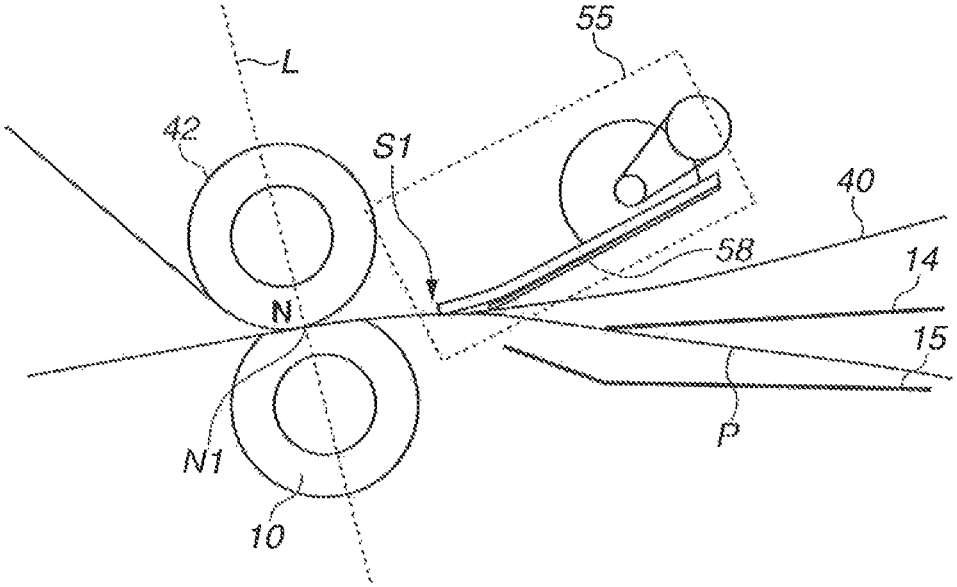
FIG. 9 is a diagram illustrating a detailed configuration of a vibration prevention member according to a third exemplary embodiment.

However, as illustrated in FIG. 9, the present invention is applicable to a vibration prevention member 55 having two sheet-shape portions that make contact with the intermediate transfer belt 40 at two positions (i.e., a plurality of positions) in the moving direction.

In the present exemplary embodiment, a sheet-shape portion provided on the upstream side has a thickness of 200 μm, whereas a sheet-shape portion provided on the downstream side has a thickness of 500 μm, each of which is made of resin such as polyester.

In the present exemplary embodiment, the intermediate transfer belt 40 has a length of 360 mm in the width direction, the movable region has a length W of 365 mm in the width direction, and both of the sheet-shape abutting portions on the upstream and the downstream sides have lengths D of 367 mm. Positions D1 and D2 at both ends of the sheet shape portions on the upstream and the downstream sides in the width directions are respectively arranged on the outsides of positions W1 and W2 of the both ends of the movable region.

In the present exemplary embodiment, edges of the sheet-shape abutting portions on the upstream and the downstream sides do not make contact with the intermediate transfer belt 40, and thus an image defect caused by generation of scraped particles can be suppressed.

In addition, the present invention is also applicable to a vibration prevention member configured to make contact with the intermediate transfer belt 40 at three or more positions in the moving direction.

While the present invention has been described with reference to exemplary embodiments, it is to be understood that the invention is not limited to the disclosed exemplary embodiments.

This application claims the benefit of Japanese Patent Application No. 2014-195818, filed Sep. 25, 2014, which is hereby incorporated by reference herein in its entirety.

What is claimed is:

1. A transfer apparatus comprising:

a transfer belt configured to carry a toner image on a surface for transferring the toner image onto a recording material;

a steering roller configured to steer the transfer belt, wherein, during a transferring operation for transferring a toner image on the transfer belt onto a recording material, at least one end of the steering roller is swingably held so that a position in a width direction of the transfer belt to be settled within a predetermined range;

a pair of transfer members disposed opposite to each other by having the transfer belt therebetween, configured to form a transfer nip that transfers a toner image on the transfer belt onto a recording material; and a pressing member provided at an upstream side in a moving direction of the transfer belt with respect to the transfer nip, configured to press an inner surface of the transfer belt, wherein the pressing member is configured to press an area within 25 mm or less from the transfer nip with respect to a moving direction of the transfer belt, and wherein the pressing member is configured to contact both ends of the transfer belt when the transfer belt is positioned to one end of the predetermined range, and contact both ends of the transfer belt when the transfer belt is positioned to the other end side of the predetermined range.

2. The transfer apparatus according to claim 1, wherein the pressing member is a sheet-shape member which contacts with the transfer belt.

3. The transfer apparatus according to claim 2, wherein the pressing member is formed with a resin material having a thickness of 0.4 mm to 0.6 mm.

4. The transfer apparatus according to claim 1, wherein the pressing member is a roller configured to rotatably contact with the transfer belt.

5. The transfer apparatus according to claim 1, further comprising:

a first sheet-shape member configured to contact with the transfer belt; and a second sheet-shape member disposed upstream side in a moving direction of the transfer belt than the first sheet-shape member, configured to contact with the transfer belt.

6. The transfer apparatus according to claim 1, further comprising:

a swinging mechanism configured to swing the steering roller;

a driving source configured to drive the swinging mechanism;

a detection member configured to detect the location in the width direction of the transfer belt; and a control unit configured to control the driving source based on a detection result of the detection member.

7. The transfer apparatus according to claim 1, wherein the steering roller comprises a non-rotary member at each of both ends of the steering roller in non-rotary manner, the steering roller swings according to frictional force generated between the non-rotary members and the transfer belt, and the transfer belt is settled within the predetermined range according to the swing.

8. The transfer apparatus according to claim 1, wherein an inner surface of the transfer belt is formed with a resin material.

9. The transfer apparatus according to claim 1, wherein a change amount of stretched surface of the transfer belt caused by a pressing force applied from the pressing member is set to be 1.0 mm to 3.0 mm.

10. A transfer apparatus comprising:

a transfer belt configured to carry a toner image on a surface for transferring the toner image onto a recording material;

a steering roller configured to steer the transfer belt, wherein, during a transferring operation for transferring a toner image on the transfer belt onto a recording material, at least one end of the steering roller is swingably held so that a position in a width direction of the transfer belt to be settled within a predetermined range;

a pair of transfer members disposed opposite to each other by having the transfer belt therebetween, configured to form a transfer nip that transfers a toner image on the transfer belt onto a recording material;

a guide member disposed opposite to the transfer belt on an upstream side in the moving direction of the transfer belt than the transfer nip, configured to guide a recording material; and a pressing member configured to press an inner surface of the transfer belt which is disposed upstream side than the transfer nip and downstream side than the guide member with respect to a moving direction of the transfer belt, wherein the pressing member is configured to contact both ends of the transfer belt when the transfer belt is positioned to one end of the predetermined range, and contact both ends of the transfer belt when the transfer belt is positioned to the other end side of the predetermined range.

11. A transfer apparatus comprising:

a transfer belt configured to carry a toner image on a surface for transferring the toner image onto a recording material;

a steering roller configured to steer the transfer belt, wherein, during a transferring operation for transferring a toner image on the transfer belt onto a recording material, at least one end of the steering roller is swingably held so that a position in a width direction of the transfer belt to be settled within a predetermined range, a pair of transfer members disposed opposite to each other by having the transfer belt therebetween, configured to form a transfer nip that transfers a toner image on the transfer belt onto a recording material; and a sheet-shape pressing member configured to press an inner surface of the transfer belt at upper stream side of a moving direction of the transfer belt with respect to the transfer nip, wherein the pressing member is configured to contact both ends of the transfer belt when the transfer belt is positioned to one end of the predetermined range, and contact both ends of the transfer belt when the transfer belt is positioned to the other end side of the predetermined range.

12. A transfer apparatus comprising:

a transfer belt configured to carry a toner image on a surface for transferring the toner image onto a recording material;

a supporting roller configured to support the transfer belt, wherein, during a transferring operation for transferring a toner image on the transfer belt onto a recording material, the transfer belt is movably settled in a width direction thereof so as to be positioned within a predetermined range in a width direction of the transfer belt;

a pair of transfer members disposed opposite to each other by having the transfer belt therebetween, configured to form a transfer nip that transfers a toner image on the transfer belt onto a recording material; and a pressing member provided upstream side in a moving direction of the transfer belt with respect to the transfer nip, configured to press an inner surface of the transfer belt, wherein the pressing member is configured to press an area within 25 mm or less from the transfer nip with respect to a moving direction of the transfer belt, contact both ends of the transfer belt when the transfer belt is positioned to one end of the predetermined range, and contact both ends of the transfer belt when the transfer belt is positioned to the other end side of the predetermined range.

13. A transfer apparatus comprising:

a transfer belt configured to carry a toner image on a surface for transferring the toner image onto a recording material;

a supporting roller configured to support the transfer belt, wherein, during a transferring operation for transferring a toner image on the transfer belt onto a recording material, the transfer belt is movably settled in a width direction thereof so as to be positioned within a predetermined range in a width direction of the transfer belt;

a pair of transfer members disposed opposite to each other by having the transfer belt therebetween, configured to form a transfer nip that transfers a toner image on the transfer belt onto a recording material;

a guide member disposed opposite to the transfer belt on an upstream side in the moving direction of the transfer belt than the transfer nip, configured to guide a recording material; and a pressing member configured to press an inner surface of the transfer belt which is disposed upstream side than the transfer nip and downstream side than the guide member with respect to a moving direction of the transfer belt, wherein the pressing member is configured to contact both ends of the transfer belt when the transfer belt is positioned to one end of the predetermined range, and contact both ends of the transfer belt when the transfer belt is positioned to the other end side of the predetermined range.

14. A transfer apparatus comprising:

a transfer belt configured to carry a toner image on a surface for transferring the toner image onto a recording material;

a supporting roller configured to support the transfer belt, wherein, during a transferring operation for transferring a toner image on the transfer belt onto a recording material, the transfer belt is movably settled in a width direction thereof so as to be positioned within a predetermined range in a width direction of the transfer belt;

a pair of transfer members disposed opposite to each other by having the transfer belt therebetween, configured to form a transfer nip that transfers a toner image on the transfer belt onto a recording material; and a sheet-shape pressing member configured to press an inner surface of the transfer belt at upper stream side of a moving direction of the transfer belt with respect to the transfer nip, wherein the pressing member is configured to contact both ends of the transfer belt when the transfer belt is positioned to one end of the predetermined range, and contact both ends of the transfer belt when the transfer belt is positioned to the other end side of the predetermined range.

* * * * *